United States Patent [19]

Mikuta et al.

[11] Patent Number: 4,575,961

[45] Date of Patent: Mar. 18, 1986

[54] GUNSIGHT ELEVATING APPARATUS

[75] Inventors: Richard Mikuta, East Hampton, Mass.; Roger Curran, Stratford, Conn.

[73] Assignee: Bangor Punta Corporation, Greenwich, Conn.

[21] Appl. No.: 530,559

[22] Filed: Sep. 9, 1983

[51] Int. Cl.[4] ..... F41G 1/16

[52] U.S. Cl. ..... 42/1 S; 33/252

[58] Field of Search ..... 42/1 S; 33/252, 254

[56] References Cited

U.S. PATENT DOCUMENTS

| | | | |
|---|---|---|---|
| 3,495,339 | 2/1970 | Elliason | 42/1 S |
| 3,648,374 | 3/1972 | Lewis | 33/254 |
| 3,662,469 | 5/1972 | Charron | 42/1 S |
| 4,012,844 | 3/1977 | Tellie | 33/252 |
| 4,200,989 | 5/1980 | Brouthers | 42/1 S |

*Primary Examiner*—Charles T. Jordan

*Attorney, Agent, or Firm*—Patrick J. Walsh

[57] ABSTRACT

Disclosed is a gun sight elevation adjusting apparatus having an adjusting screw threaded into the sight elevation body for adjusting the elevation of the sight. The screw has an annular groove and a plurality of circumferentially spaced indentations thereabout below the groove. A generally U-shaped clip is retained on the screw as its legs straddle the screw about the groove. A tang is bent out of the plane of the clip and its point rides on the screw to engage in the indentations upon rotation of the screw and registration of the indentations with the tip. The clip prevents the screw from being removed from the sight body and provides an audible click to click and a positive snap-like feel adjustment for the sight.

6 Claims, 3 Drawing Figures

GUNSIGHT ELEVATING APPARATUS

BACKGROUND OF THE INVENTION

The present invention relates to apparatus for adjusting the elevation of a sight on a gun and particularly relates to a rear gun sight elevating apparatus including a spring retainer clip cooperable with a sight adjusting screw to provide bidirectional detenting action and accurate click to click positive snap feel sight adjustment.

Many different designs for adjusting the elevation of the rear sight on guns have been proposed and constructed in the past. Many of these are deficient in certain respects. For example, certain sight elevation adjustments using an adjustable screw for elevating or lowering the sight are prone to readily come out of adjustment. A detent may not be provided or, if provided, may have insufficient retention capacity to maintain the adjusting screw in its adjusted position. Others do not provide a mechanism for preventing the screw from being unthreaded and hence removed in its entirety from the sight elevating apparatus. Still others do not provide the very desirable audible click to click adjustment or the accompanying positive snap feel in finding proper adjustment. Moreover, most gun sight adjustment apparatus are somewhat expensive in construction, complicated in use, and frequently do not interface well with the gun.

SUMMARY OF THE INVENTION

Accordingly, it is a primary object of the present invention to provide a novel and improved apparatus for adjusting the elevation of a gun sight.

It is another object of the present invention to provide a novel and improved apparatus for adjusting the elevation of a gun sight of the type utilizing an elevation adjusting screw wherein a retainer spring clip is used to provide a bidirectional detent, an audible click to click adjustment and a positive snap feel in the course of the adjustment.

It is still another object of the present invention to provide a novel and improved apparatus for adjusting the elevation of a gun sight having the foregoing characteristics in which the clip is of unitary or one piece construction and simple and inexpensive to manufacture.

It is a further object of the present invention to provide a novel and improved apparatus for adjusting the elevation of a gun sight having the foregoing characteristics wherein the spring retainer clip and the adjusting screw cooperate to provide easy control of and a high degree of accuracy in click to click adjustments and also to limit the extent of threading action between the adjusting screw and the sight thereby precluding removal of the adjusting screw from the sight.

Additional objects and advantages of the present invention will be set forth in part in the description which follows and, in part, will be obvious from the description, or may be learned by practice of the invention. The objects and advantages of the invention may be realized and attained by means of the instrumentalities and combinations particularly pointed out in the appended claims.

To achieve the foregoing and other objects and advantages and in accordance with the purposes of the present invention, as embodied and broadly described herein, a gun sight elevation aparatus constructed in accordance with the present invention comprises a movable sight body for securement to the gun, a sight elevation adjusting screw threadedly engaged with the sight body and cooperable with the gun for displacing the sight body relative to the gun in response to threading the screw relative to the sight body, the adjusting screw having an annular groove and a plurality of indentations circumferentially spaced about the screw, and a generally U-shaped clip having a pair of laterally spaced legs engageable in the groove for retaining the clip in engagement with the screw and preventing removal of the screw from the sight body by threading the screw relative to the sight body in one axial direction of the screw, the clip having a detent disposed between the clip legs for engaging in the indentations and detenting the screw in an adjusted threaded position thereof.

Preferably, the indentations are spaced axially along the screw from the groove. Also, the dentent comprises a tang formed out of the plane containing the clip. The tang has a pointed tip for engaging the indentations. The tang is resilient such that, when it rides high on the screw between indentations, it is biased to positively snap into the next indentation when the latter registers with the tip of the tang. Thus, a positive snap-like feel and audible click to click adjustment is provided.

The accompanying drawings which are incorporated in and constitute a part of this specification, illustrate one embodiment of the invention and, together with the description, serve to explain the principles of the invention.

DESCRIPTION OF A PREFERRED EMBODIMENT

Reference will now be made in detail to the preferred embodiment of the present invention, an example of which is illustrated in the accompanying drawings.

Figure 1:
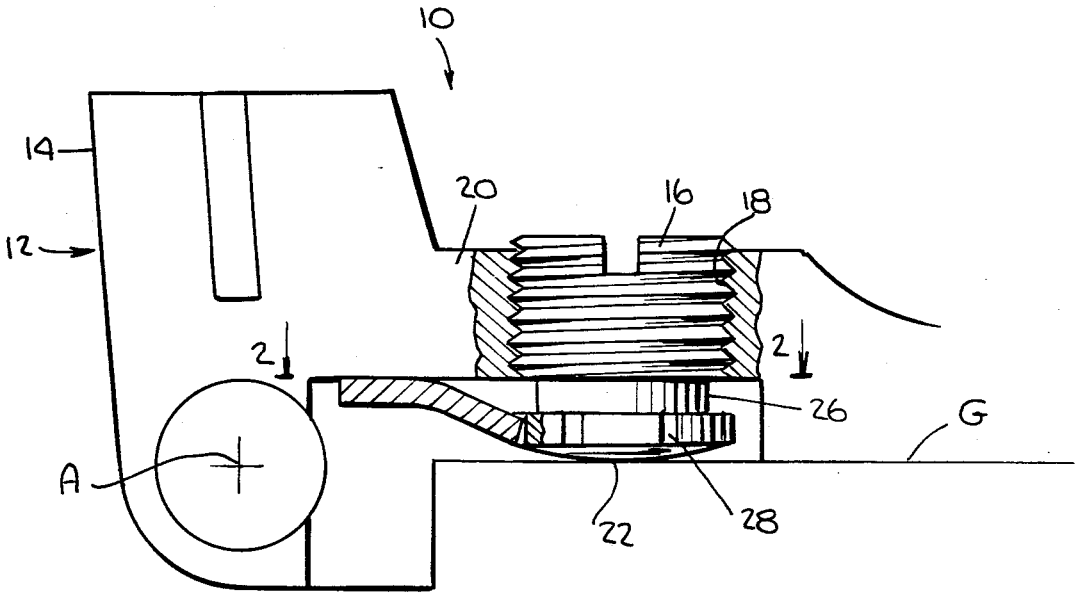
FIG. 1 is a fragmentary vertical cross sectional view of apparatus for adjusting the elevation of a gun sight constructed in accordance with the present invention taken generally about line 1—1 in FIG. 2 and illustrating the sight mounted on a gun.

Referring now to the drawing Figures, particularly to FIG. 1, there is illustrated apparatus, generally designated 10, for adjusting the elevation of a gun sight, generally designated 12. The gun sight 12 illustrated is a rear gun sight mounted on a gun designated G. Generally, gun sight 12 includes a signt body 14 conventionally mounted for pivotal movement relative to the gun about a pivot axis A. The sight body including a sighting groove or aperture, not shown, for use in conjunction with a front sight, not shown, for aiming the gun at a target in a conventional manner. It will be appreciated that, by adjusting the elevation of the rear sight, the gun may be sighted for distance and accuracy.

The gun sight elevation adjusting apparatus 10 includes an adjusting screw 16 for threaded engagement in a bore 18 in a portion 20 of sight body 14 forward of the sighting groove or aperture and also forward of the pivot axis A of sight body 14. The lower end face 22 of the adjusting screw 16 bears on the gun frame 24. A spring, not shown, biases sight body 14 for pivotal movement about axis A in a direction tending to maintain the lower end face 22 of adjusting screw 16 in engagement against the gun frame 24. Thus, by threading and unthreading adjusting screw 16; e.g., by means of a screwdriver, sight body 14 may be pivoted about axis A to raise and lower the sighting groove or aperture relative to the gun as desired.

For reasons discussed in detail hereinafter, adjusting screw 16 is provided with an annular groove 26 below the threaded portion thereof. Also, a plurality of radial indentations 28 are provided at circumferentially spaced locations about screw 16. Indentations 28 are preferably radially inwardly directed, generally V-shaped, grooves at equally spaced circumferential locations about screw 16. Further, the indentations or radial grooves 28 are disposed at a location along th screw 16 spaced axially below annular groove 26.

Apparatus 10 further includes a clip 30 which performs a multiplicity of functions as described hereinafter. Clip 30 is generally U-shaped having a pair of legs 32 which project from a base portion 34 of the clip. The legs 32 are arcuate in configuration to conform to the circular shape of and engage about annular groove 26. Clip 30 includes a central tang or detent 36 which extends from base portion 34 between the legs 32 to a location short of the beginning of the arcuate portions of legs 32. Detent 36 terminates in a generally V-shaped pointed tip 38 for engaging in the indentations or radial grooves 28 as discussed hereinafter.

Clip 30 is preferably formed of a one piece unitary construction and is formed to lie in a single plane except for detent 36. As best illustrated in FIG. 1, detent 36 is formed to incline downwardly and forwardly out of the plane containing the legs 32 and base portion 34 of clip 30 such that its pointed tip 38 lies below the plane of the clip. Also, to facilitate forming the detent 36 to incline forwrdly and downwardly and to facilitate a spring action described hereinafter, a slit is formed between the detent 36 and each of the legs 32. Small apertures 40 are formed in the base portion 34 at the inner ends of the slits and also facilitate the spring action described hereinafter. Preferably, clip 30 is formed of sheet metal thus facilitating simple and inexpensive manufacture thereof. Of course, clip 30 could be formed of other materials; such as plastic materials.

Figure 2:
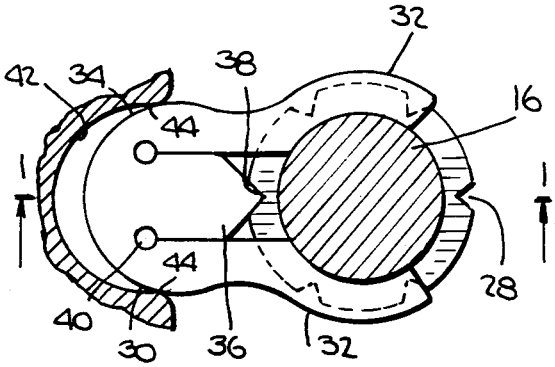
FIG. 2 is a cross sectional view thereof taken generally about on line 2—2 in FIG. 1.
Figure 3:
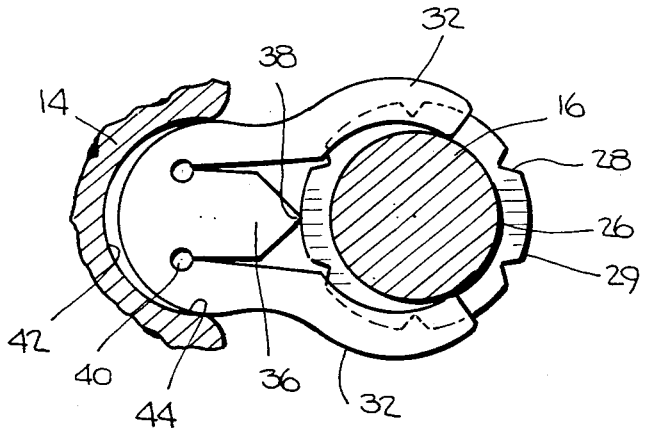
FIG. 3 is a cross-sectional view corresponding to FIG. 2 and illustrates the gun sight elevating apparatus being adjusted.

In use, the clip 30 is allowed to move vertically with screw 16 but is constrained from rotation with the screw by the base 34 of clip being contained within slot 42 in body 14. As shown in FIG. 2 the curved wall surface of slot 42 engages opposed edges 44 of the clip thereby retaining it against rotation. The legs 32 are disposed on opposite sides of and in the anular groove 26 of adjusting screw 16. With detent 36 formed out of the plane of the clip, it will be appreciated that its pointed tip 38 is located to engage in one of the indentations or radial grooves 28. Thus, screw 16 may be rotated in either direction to provide elevation adjustment to the sight while the legs 32 of clip 30 continuously engage in the annular groove 26 of the screw. Also, when the screw 16 is rotated to locate an indentation or radial groove 28 in opposition to detent 36, the detent is spring biased to positively engage its pointed tip in the opposing groove. That is, the configuration of the clip 30 is such that when the pointed tip of the detent engages or rides high along the outer surface of the screw between the indentations 28, the detent by its construction, is naturally resiliently biased for movement in a direction to engage its pointed tip 38 in the next indentation when in opposition thereto. As shown in FIG. 3, rotation of the screw 16 forces the tip 38 to ride the outer surface 29 of the screw as the clip undergoes a slight movement to the left toward the slot 42. In the position shown, the legs 32 of the clip are resiliently biased and urge the clip to the right so that the tip will engage the next indentation. Thus, a positive snap-like action occurs each time the detent engages in an indentation. This action also provides the desirable audible click to click adjustment.

It will be appreciated tha the foregoing described action occurs upon threading action of the screw relative to the sight body in either direction. Furthermore, the indentations about the screw provide for easy control of and a high degree of accuracy in click to click adjustments. It will also be appreciated that the detent prevents inadvertent or accidental threading action of the screw in the sight body while simultaneously permitting rotation of the screw upon application of a positive threading or unthreading force to the screw. Also, the legs 32 in the annular groove 28 in cooperation with the sight body preclude removal of the screw from the sight body even if positive unthreading action is applied, either purposely or inadvertently, to the screw in an effort to remove the screw. The legs 32 will bind against the screw and the sight body should removal of the screw be attempted.

It will be apparent to those skilled in the art that various modifications could be made in the gun sight elevation adjusting apparatus hereof without departing from the scope or spirit of the invention.

We claim:

1. Apparatus for adjusting the elevation of the sight on a gun comprising:

a movable sight body for securement to a gun, a sight elevation adjusting screw threadedly engaged with said sight body and cooperable with the gun for displacing said sight body relative to the gun in response to threading said screw relative to the sight body, said adjusting screw having an annular groove and a plurality of indentations circumferentially spaced about said screw, and a generally U-shaped clip having a pair of laterally spaced legs engageable in said groove for retaining said clip in engagement with said screw and preventing removal of said screw from said sight body, said clip having a detent disposed between said clip legs for engaging in said indentations and detenting said screw in an adjusted threaded position thereof, and said body having means for retaining the clip against rotation.

2. Apparatus according to claim 1 wherein said clip is of unitary construction.

3. Apparatus according to claim 2 wherein said indentations about said screw are disposed at a location therealong axially spaced from said groove, said clip being formed of sheet metal with said detent comprising a tang bent out of the plane of said clip, said tang having a generally pointed tip for engaging said indentations.

4. Apparatus according to claim 2 wherein said clip includes a base from which said legs project, said detent comprising a tang projecting from said base between said legs and having a pointed end and a slit between said tang and each leg to enable the pointed end of said tang to resiliently engage the indentations upon threading said screw whereby a click to click audible snap feel adjustment of said sight is provided.

5. Apparatus according to claim 4 wherein said indentations about said screw are disposed at a location therealong axially spaced from said groove, said clip being formed of sheet metal with said tang bent out of the plane of the clip.

6. Apparatus according to claim 2 wherein said indentations about said screw are disposed at a location therealong axially spaced from said groove, said clip being generally formed to lie in a single plane, said detent including a tang formed out of the plane of said clip and resiliently engageable in said indentations upon threading said screw.

* * * * *